US005826706A

United States Patent [19]

Karasik

[11] Patent Number: 5,826,706

[45] Date of Patent: Oct. 27, 1998

[54] CONTACT MECHANISM FOR A SWITCH

[75] Inventor: Vladimir G. Karasik, Walled Lake, Mich.

[73] Assignee: UT Automotive Dearborn, Inc., Dearborn, Mich.

[21] Appl. No.: 865,662

[22] Filed: May 30, 1997

[51] Int. Cl.[6] ..... H01H 1/06

[52] U.S. Cl. ..... 200/277; 200/503; 200/276

[58] Field of Search ..... 200/245, 253, 200/503, 293, 275, 276, 277, 290

[56] References Cited

U.S. PATENT DOCUMENTS 3,903,390 9/1975 Cottereau ..... 200/277

5,178,264 1/1993 Russell, II ..... 200/503

5,598,917 2/1997 Thomas ..... 200/503

*Primary Examiner*—David J. Walczak

*Attorney, Agent, or Firm*—Howard & Howard

[57] ABSTRACT

A contact mechanism for use with a switch has at least two spaced stationary electrical contacts. The contact mechanism includes a rolling contact member. The contact mechanism moves between a circuit closed position where the rolling contact member electrically joins the stationary electrical contacts, and a circuit open position where the rolling contact member does not join the stationary electrical contacts.

10 Claims, 5 Drawing Sheets

CONTACT MECHANISM FOR A SWITCH

TECHNICAL FIELD

The present invention relates to an electrical contact mechanism for use in a switch, and more particularly to an improved electrical contact mechanism for use in switches in for example automotive applications.

BACKGROUND OF THE INVENTION

Electric switches for activating and deactivating various electrical functions are well know in the art. One example of such switches are the low current automotive multi-function switches. These multi-function switches may be used to actuate turn signals, washer/wipers, high/low/pass beams, and hazard lights.

These types of switches generally include an incomplete circuit embedded in for example a printed circuit board or a plastic housing. The circuit terminates in a pair of spaced stationary electrical contacts also embedded in the board or housing. These switches also include a movable contact mechanism that supports movable electrical contacts. In order to complete the electrical circuit on the board, the contact on the contact mechanism must be moved to electrically join the stationary electrical contacts. In order to break this electrical circuit, the contact on the contact mechanism must be displaced out of the electrically-conductive relationship with the stationary contacts. In conventional multi-function switches both the printed circuit board and the contact mechanism are supported in a housing and the contact mechanism is manually actuated to make or break the engagement between stationary contacts using a handle or the like.

Current contact mechanism designs are often called "spring leaf" designs and include a box-like plastic housing and a conductive plate. The conductive plate is bent so that a base portion is adapted to engage one surface of the housing, and spaced fingers extend at an angle from the base portion. Upon assembling the switch, the fingers of the contact mechanism engage the surface of the board, and the geometry of the fingers causes them to exert contact pressure on the printed circuit board. Upon sliding the contact mechanism, the fingers touch the stationary contacts and move thereon along the direction of the contact mechanism's movement. In the working position the fingers electrically join the stationary contacts completing the circuit, and exert contact pressure on the stationary contacts. Upon sliding the contact mechanism in the opposite direction, the fingers move off of the stationary contacts along the direction of the contact mechanism's movement. Once in the contact free position, the fingers no longer join the stationary contacts and the circuit on the board is incomplete again.

These switches must have good electrical conductivity, and adequate resistance to chemical corrosion and mechanical wear. The current spring leaf contact mechanism design has problems satisfying these requirements. Good electrical conductivity is achieved by designing the conductive plate to exert enough contact pressure to achieve the desired electrical conductivity between the stationary contacts. Good electrical conductivity is also achieved by minimizing oxide films which form on the surface of the contacts. In this design the movement of the fingers over the stationary contacts causes the mechanical wear of the oxide films that build up, thus improving conductivity. This is termed the "wiping" action of the contact mechanism and is most beneficial in cleaning the surface of minor films and brushing aside particle contaminations. The wiping action also tends to smooth out transferred material, lessen a tendency for contact sticking, and smooth the contact surface so that increased contact surfaces engage thus increasing electrical conductivity. Relatively low contact pressure might be tolerated in switch design only with noble metal coatings on the movable and stationary contacts, such as gold, silver, platinum and their alloys, which form a thin, easy to puncture oxide film. However, the large increases in price resulted in a search for less costly reliable substitutes, which require higher contact pressure to meet switch performance requirements.

With higher contact pressure, conductivity is good but life cycle requirements cannot be met without wearing off coatings, which protect against corrosion. Thus a good conductive substrate such as copper is coated with a noble metal to protect the copper base material. Once the protective coating is worn away, the copper base material is easily corroded thus decreasing the performance of the switch. Due to these contradictory requirements of high contact pressure and low mechanical wear, the contact mechanism must be designed so that the contact pressure allows good electrical conductivity but does not wear down the contacts prematurely.

In an effort to achieve these requirements, the chemical protective coating is supplemented with other coating layers with higher material hardnesses to increase wear resistance. These additional coatings allow higher contact pressures while minimizing wear. However utilizing these multiple coatings increases the cost of the switches.

There is an additional problem with the current design. During assembly lubricants are applied to the stationary contacts to ensure the sliding friction between the parts remains within a predetermined range. After a number of cycles the lubricant is rubbed off of the sliding contact along the path of the contacting mechanism's movement, and is deposited along the sides of the stationary contacts where it is useless. As a result, the optimum amount of lubricant does not remain in the proper position during the required life cycle, sliding friction increases, and mechanical wear increases undesirably.

In addition, creating the contact pressure with the bent conductive plate makes the range of contact pressures vary undesirably between each system. Each conductive plate also does not exhibit constant contact pressure over the life of the mechanism, but tends to decrease due to stress material relaxation and age.

Therefore, a contact mechanism is sought, which allows the higher contact pressure to maximize good electrical contact, minimize chemical corrosion and mechanical wear with "wiping" action performed. It is also desired that the contact pressure be constant system to system and over the life of the mechanism.

SUMMARY

According to an embodiment of the present invention, a contact mechanism for use with an incomplete circuit terminating in at least two spaced stationary contacts includes a housing, a rolling contact member and a biasing member. The rolling contact member is supported in rolling engagement by the housing. The biasing member engages the housing, and forces the rolling contact member to exert contact pressure against the stationary contacts. The rolling contact member has a circuit open position where the rolling contact member does not electrically connect the stationary contacts, and a circuit closed position where said rolling contact member electrically joins the stationary contacts.

When moving the contact mechanism between the circuit open position and the circuit closed position the rolling contact member rolls along the surface of the stationary contacts.

In one embodiment the rolling contact member is a compression contact spring. Thus when the housing is in the working position, the contact spring mostly rolls over the stationary contacts with minimal sliding, and exerts contact pressure against the stationary contacts. When moving between these circuit positions the spring rolls and performs the wiping action. As a result the contact pressure can be increased while minimizing wear since rolling friction is less than sliding friction. In another embodiment the contact mechanism further includes a carriage for supporting the rolling contact member.

The foregoing invention will become more apparent in the following detailed description of the best mode for carrying out the invention and in the accompanying drawings.

BEST MODE FOR CARRYING OUT AN EMBODIMENT THE INVENTION

Figure 1:
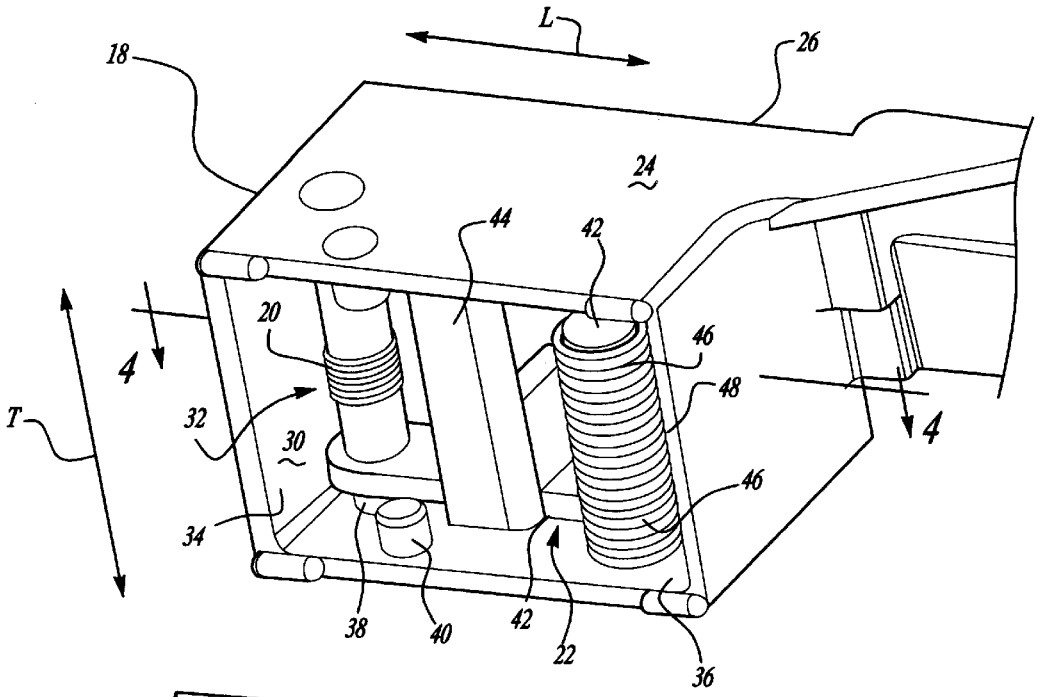
FIG. 1 is a partial perspective view of a contact mechanism of the present invention.
Figure 1:
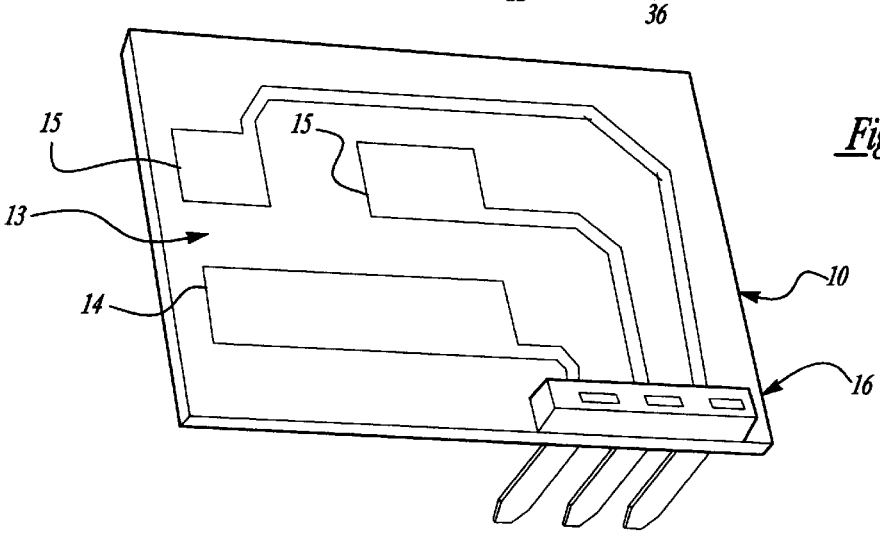

Referring to FIGS. 1, a printed circuit board 10 is for use with a contact mechanism 12. The printed circuit board 10 includes an incomplete electrical circuit 13 embedded in the printed circuit board which includes a first, common or ground stationary electrical contact 14 and second spaced stationary electrical contacts 15 terminating in header 16.

The contact mechanism 12 includes a housing 18, biasing member 20, and a carriage 22. The housing 18 is formed by a plurality of interconnected walls, such as sidewalls 24, and upper wall 26, as is known in the art. The upper wall 26 joins the sidewalls 24 and extends from the sidewalls 24 to form an arm 28 for joining the contact mechanism to the switch actuation device (not shown). The housing 18 supports the other components of the contact mechanism. The walls of the housing define a chamber 30 therein and an opening 32.

The housing 18 further includes a longitudinally extending axis L, a perpendicular transversely extending axis T, a front end 34, a spaced opposed rear end 36, a cylindrical rod 38, and a stopping means 40.

The front end 34 of the housing 18 is adapted to support the cylindrical rod 38 which extends transversely between two parallel side walls 24. The cylindrical rod 38 supports the biasing member 20, which in this embodiment is a torsion spring wrapped thereabout.

The housing 18 between the front and rear ends 34 and 36 is adapted to support the stopping means 40. In this embodiment the stopping means includes two pins which extend inwardly from parallel side walls 24. The stopping means prevents movement of the carriage beyond a certain point.

The H-shaped carriage 22 is formed from integral parallel side arms 42 that are joined substantially at the center by a cross-bar 44. The ends of the side arms 42 adjacent the front end 34 of the housing 18 are adapted to pivotally engage the cylindrical rod 38. The opposite ends of the side arms 42 have inwardly extending pins 46. The carriage further includes a rolling contact member 48, which in this embodiment is a compression contact spring wrapped about the pins 46.

Figure 2:
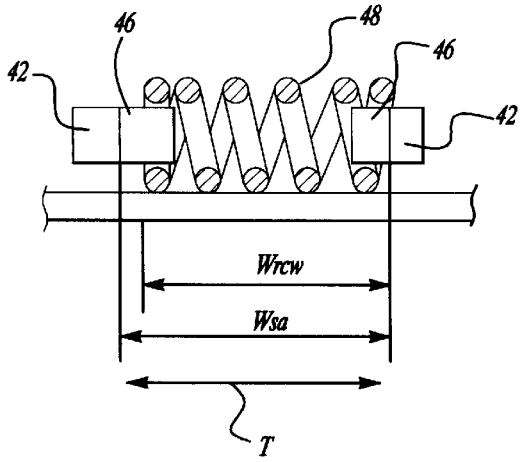
FIG. 2 partial cross-sectional view of a carriage and a rolling contact member of the present invention.

Referring to FIG. 2, the width between the carriage side arms 42 is represented by an arrow $W_{sa}$. The width of the rolling contact member 48 is represented by an arrow $W_{rcm}$. In order for the contact mechanism 12 to operate as described below, the width of the rolling contact member $W_{rcm}$ must be less than the width between the carriage side arms $W_{sa}$, so that the rolling contact member 48 is free to move transversely along the axis T.

Figure 4A:
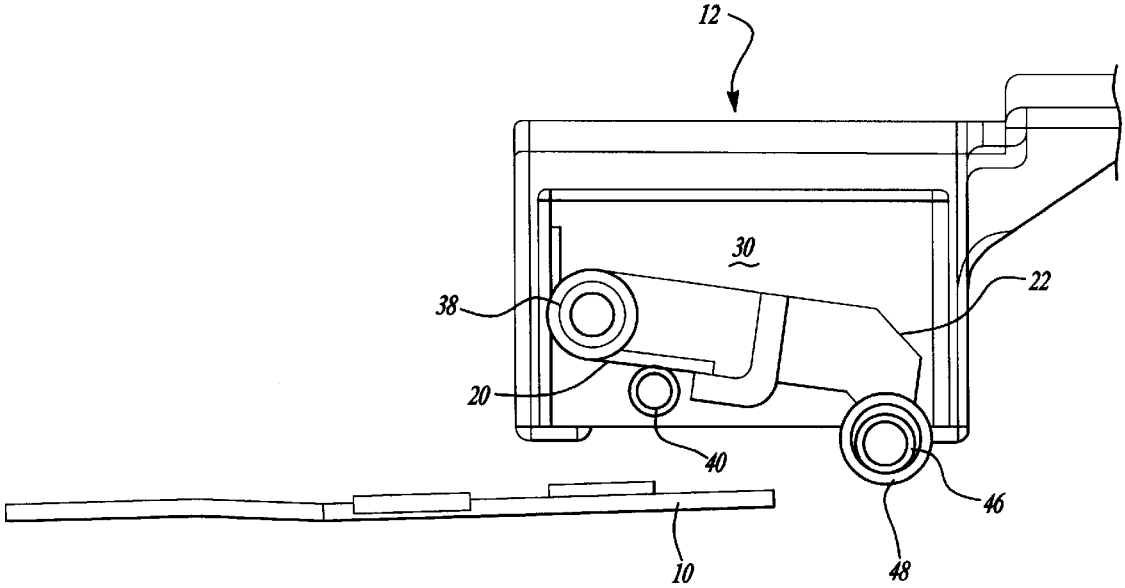
FIG. 4*a*, 4*b*, and 4*c* are a partial cross-sectional views of the contact mechanism along line 4—4 of FIG. 1 of the contact mechanism in an initial contact free position, a closed circuit working position, and an open circuit working position, respectively.

Operation of the contact mechanism 12 will now be discussed with reference to FIG. 4*a*. When the contact mechanism 12 is in the initial contact free position, the compression contact spring 48 is not in electrical contact with the printed circuit board 10. In this position the torsion spring 20 is biasing the carriage 22 into contact with the stopping means 40. The free ends of the torsion spring 20 engage the cross bar 44 of the carriage 22 exerting pressure thereon (as shown in FIG. 1). Furthermore, the compression contact spring 48 is substantially outside of the chamber 30.

Figure 3A:
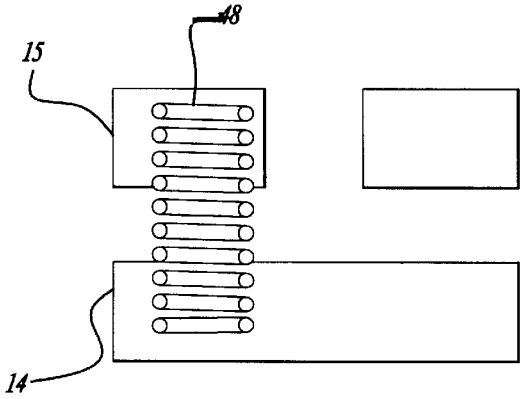
FIG. 3*a* and 3*b* are a partial top views of the contact mechanism in FIG. 1 in a closed circuit position and an open circuit position.
Figure 4B:
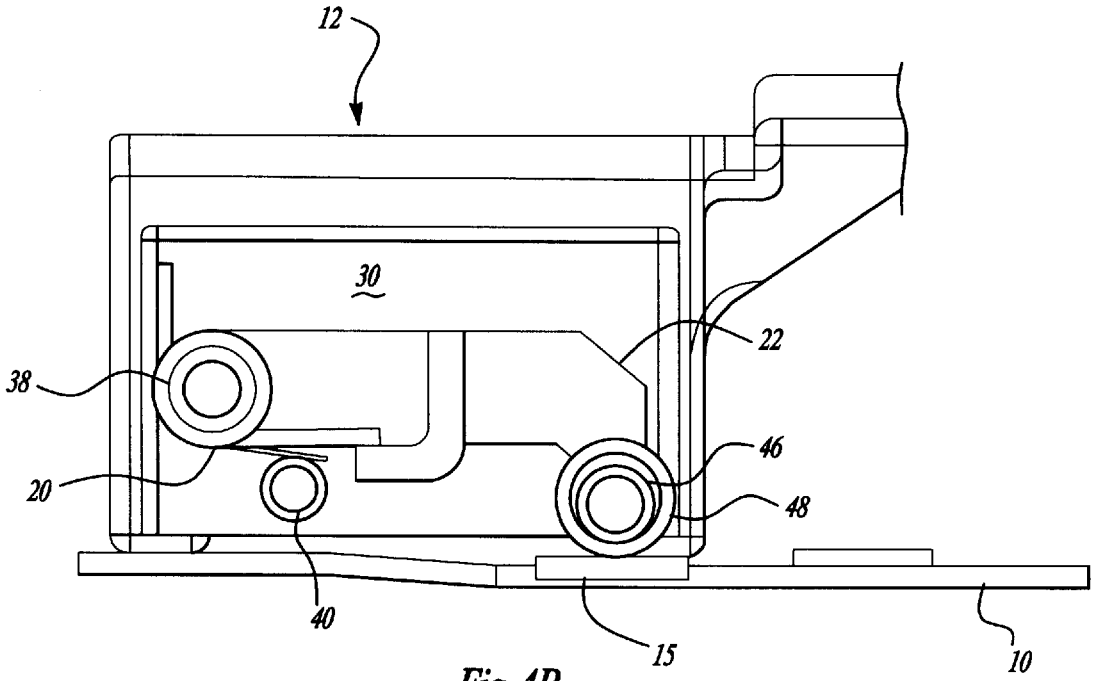
Figure 4C:
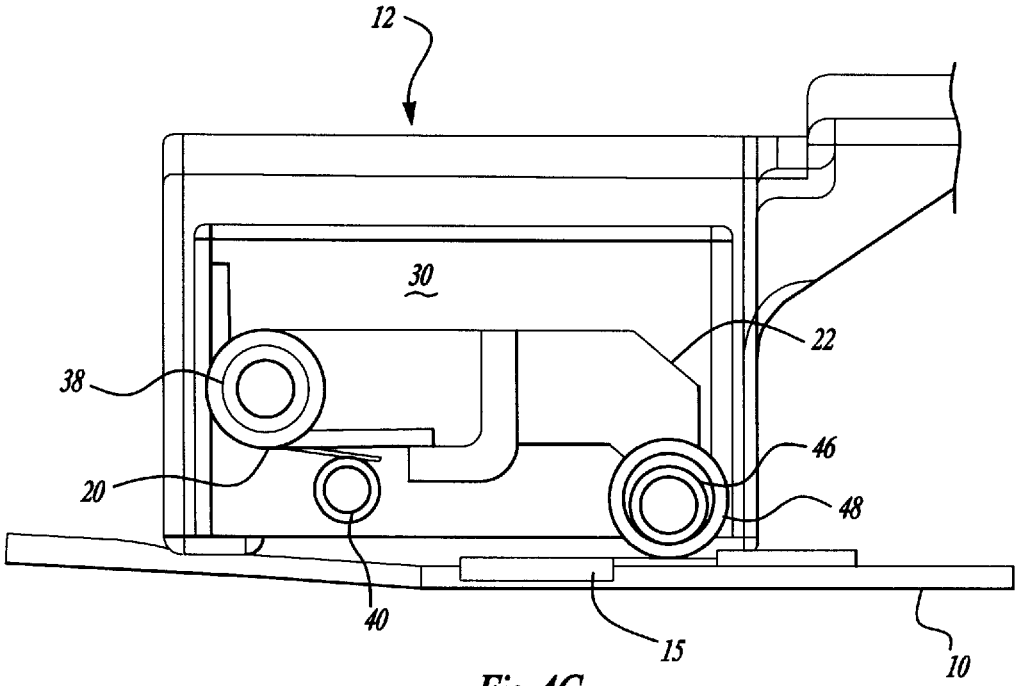

Referring to FIGS. 4*b* and 4*c*, once the compression contact spring 48 engages the printed circuit board 10 the board forces the contact spring 48 substantially into the chamber 30, and the contact spring exerts a contact pressure on the board due to the torsion spring 20. Once the rolling contact member 48 electrically joins the first and second stationary contacts 14 and 15 (as shown in FIG. 3*a*), the circuit 13 on the printed circuit board 10 is complete and the desired function occurs. This is the closed circuit final working position of the contact mechanism 12.

Figure 3B:
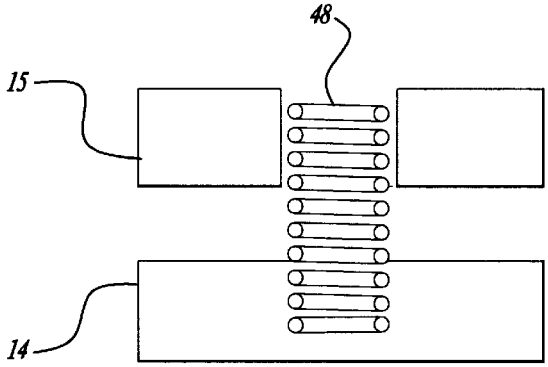

Once the rolling contact member 48 does not electrically joins the first and second stationary contacts 14 and 15 (as shown in FIG. 3*b*), the circuit 13 on the printed circuit board 10 is incomplete and the desired function does not occur. This is the open circuit final working position of the contact mechanism 12.

Upon moving the contact mechanism along the longitudinal axis L, between the closed and open circuit final working positions, the contact spring 48 rolls due to friction. Since the coils of the contact spring are angularly offset from the longitudinal axis L, and the width $W_{rcm}$ is less than $W_{sa}$ (as shown in FIG. 2) the contact spring also moves along the transverse axis T. The contact spring implements the electrical contact by rolling along the axis L, and the wiping action by sliding along the transverse axis T. Travel along the T axis is much less than along the L axis. The wiping action occurs at random locations along the L axis. Due to factors such as material, wire diameter, and spring size the contact spring 48 is selected so that as coils at one end of the spring stops rolling, the spring begins to compress toward the non-rolling coils, while the other coils at the other end of the spring continue to roll. When the compressive force built up in the spring exceeds the friction force, the spring decompresses and moves along the transverse axis. Both these transverse motions are the "wiping" action of the spring.

Since the spring is free to rotate during movement of the contact mechanism, the friction force between the contacts is reduced thereby reducing wear on the stationary contact.

Figure 5:
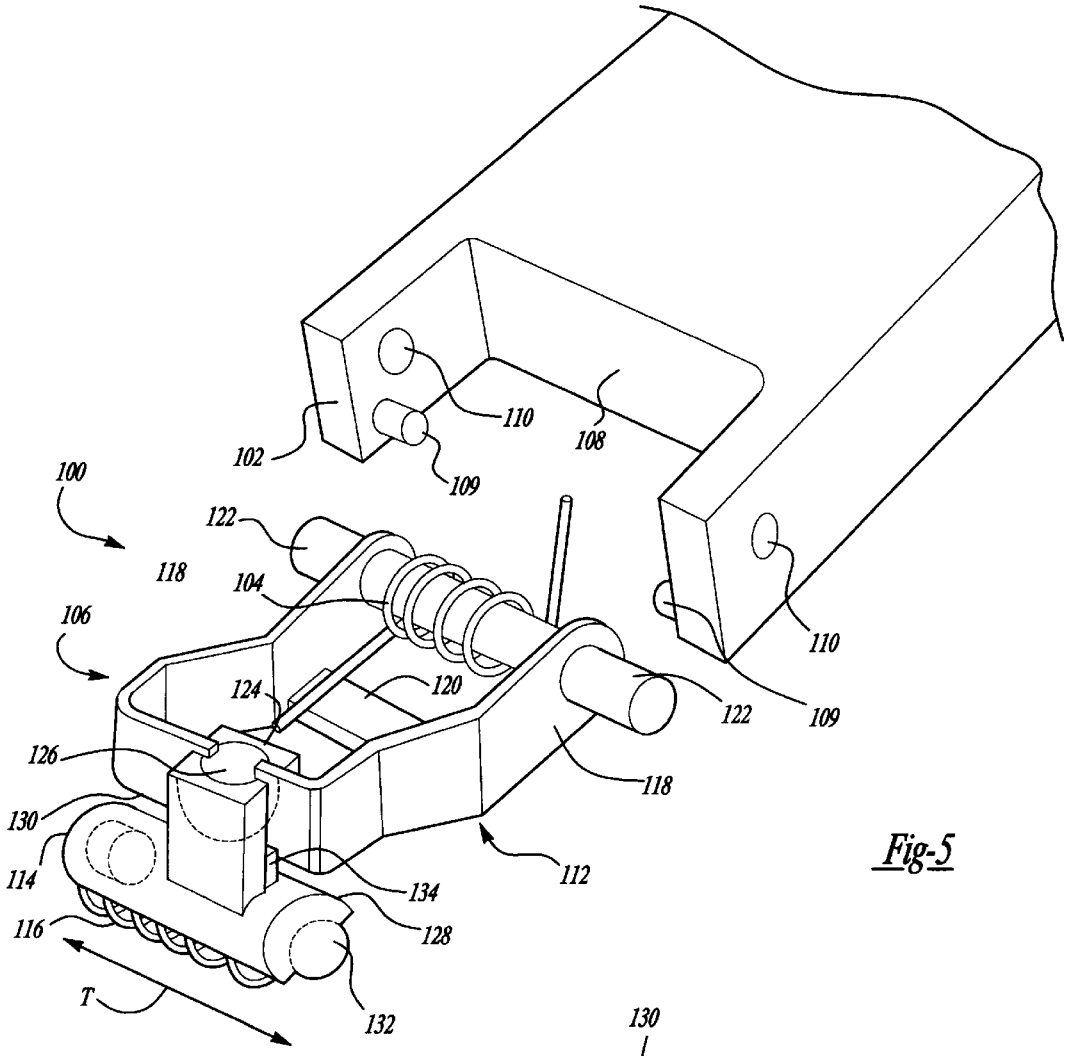
FIG. 5 is a partial exploded perspective view of another embodiment of the contact mechanism of the present invention.

Referring to FIG. 5, another embodiment of the contact mechanism 100 is shown. The contact mechanism 100 includes a housing 102, a biasing member 104, and a carriage 106. The housing 102 includes a U-shape wall structure 108 and a stopping means 109. Each of the spaced parallel walls forms a hole 110. The U-shaped wall structure is adapted to support the stopping means 109 which in this embodiment are two inwardly extending pins.

The biasing member 104 is a torsion spring. The torsion spring is formed so that legs of the torsion spring that include the free ends are perpendicular to one another.

The carriage 106 includes a first retainer 112 for supporting the torsion spring 104, a second retainer 114 for supporting a rolling contact member 116.

The first retainer 112 is substantially U-shaped. The first retainer is formed by two spaced L-shaped side arms 118 joined by a centrally disposed cross bar 120. One end of each side arm 118 includes a cylindrical pin 122 that extends therethrough. The other end of each side arm 118 has a circular edge 124. The first retainer 112 further includes a spherical member 126. The spherical member 126 is disposed between the circular edges 124 of each side arm.

Figure 6:
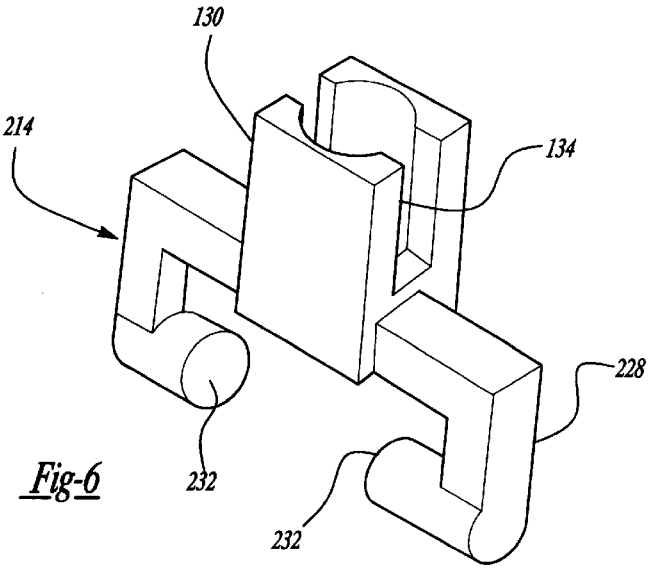
FIG. 6 is a perspective view of another embodiment of a second spring retainer.

The second retainer 114 is substantially T-shaped. The second retainer 114 is formed by a first member 128 and an attached second member 130 attached to and extending perpendicularly from the first member 128. The first member 128 is adapted to support two transversely extending pins 132. The second member 130 includes a slot 134 (as shown in FIGS. 5 and 6). The slot 134 is contoured to receive the side arms 118 and the spherical member 126 of the first retainer 112.

Assembly of the contact mechanism 100 will now be discussed. The rolling contact member 116 in this embodiment is a compression contact spring as discussed above, and the dimensions of the contact spring in relation to the carriage are as discussed above. The compression contact spring 116 is compressed and inserted between the pins 132 of the second retainer 114. Upon releasing the spring 116 it rests upon these pins in rolling engagement. The second retainer 114 is mated with the first retainer 112 by inserting the spherical member 126 and the side arms 118 within the slot 134 in the second retainer 114. Thus, the carriage 106 includes a ball-and-socket joint. The torsion spring 104 is compressed and moved between the pins 122 of the first retainer 112 and released so that the torsion spring 104 is supported by the pins 122. One leg of the torsion spring is adjacent the cross bar 120 of the first retainer 112. The first retainer 112 is compressed so that the pins 122 move toward one another. Once the pins 122 are aligned with the holes 110 in the housing, the first retainer 112 is released, and the pins 122 extend through the holes 110. The other leg of the torsion spring 104 is adjacent the wall of the housing 102.

Operation of the contact mechanism 100 is similar to that discussed above with one enhancement. Once the compression contact spring 116 engages the printed circuit board 10, the board exerts a force the contact spring 116. Once the legs of the torsion spring 104 contact the cross bar 120 and the housing 102, the torsion spring 104 biases the carriage 106 toward the board and the contact spring 116 exerts a contact pressure on the board. The ball-and-socket joint between the first and second retainer allows the second retainer 114 to move until most if not all of the compression contact spring 116 coils make contact with the printed circuit board and stationary contacts. The principal advantage of this design is the contact mechanism is self-adapting to the contact surface, so that any deviations in manufacturing or assembly will not prevent the entire surface of the compression contact spring from mating with the printed circuit board and stationary contacts. Thus, improving reliability of the electrical contact.

Referring to FIG. 6, the second retainer 214 has been modified from the one shown in FIG. 5. The second retainer 214 has been changed and now includes a C-shaped first member 228. The first member 228 includes pins 232 for supporting the compression contact spring 116 (as shown in FIG. 5).

Figure 7:
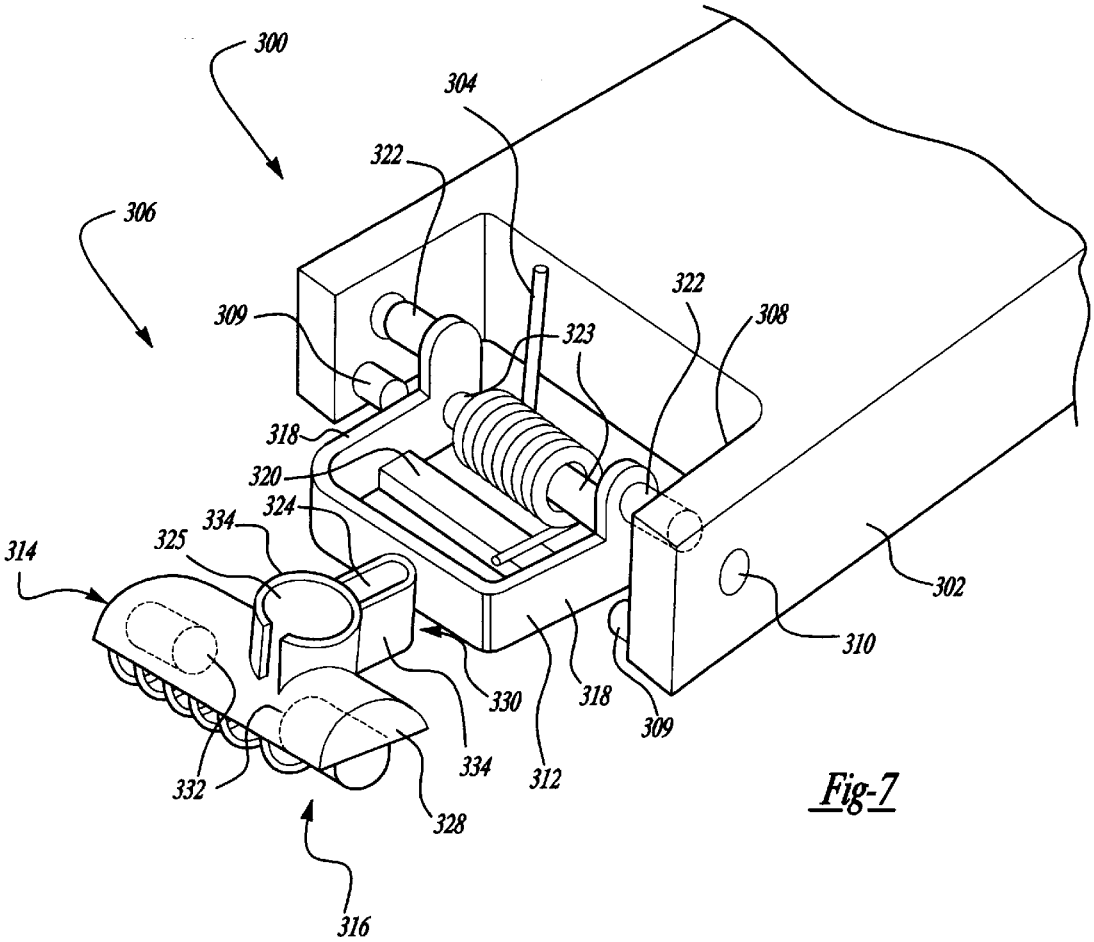
FIG. 7 is a partial exploded perspective view of another embodiment of the contact mechanism of the present invention.

Referring to FIG. 7 the contact mechanism 300 has been modified from that shown in FIG. 5. The contact mechanism 300 includes a housing 302, a biasing member 304, and a carriage 306. The housing 302 includes a U-shape wall structure 308 and a stopping means 309. Each of the spaced parallel walls forms a hole 310. The U-shaped wall structure is adapted to support the stopping means 309 which in this embodiment are two inwardly extending pins.

In this embodiment the biasing member 304 is a torsion spring. The torsion spring is formed so that legs of the torsion spring that include the free ends are perpendicular to one another.

The carriage 306 includes a first retainer 312 for supporting the torsion spring 304, a second retainer 314 for supporting a rolling contact member 316.

The first retainer 312 is substantially U-shaped. The first retainer includes two integrally formed spaced L-shaped side arms 318 joined by a centrally disposed cross bar 320. Each side arm 318 includes two outwardly extending pins 322 at the free ends and two offset inwardly extending pins 323 spaced from the free ends. The first retainer 312 further includes an extension 324 extending outwardly therefrom, the extension having a spherical member 325 integrally formed therewith.

The second retainer 314 is substantially T-shaped. The second retainer 314 is formed by a first member 328 and a second member 330 attached to and extending perpendicularly from the first member 328. The first member 328 is adapted to support two transversely extending pins 332. The second member 330 is formed by two spaced members 334 having a curved contour that matches that of the spherical member 325.

Assembly and operation of the contact mechanism 300 is similar to that discussed above in connection with FIGS. 1 and 6.

Figure 8:
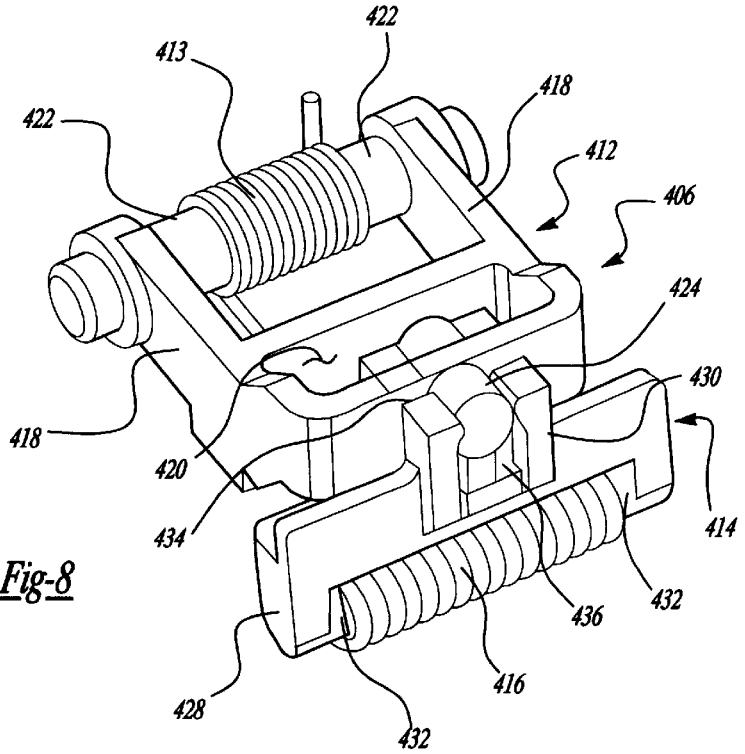
FIG. 8 is a perspective view of another embodiment of a carriage.

Referring to FIG. 8, the carriage 306 has been modified. The carriage 406 includes a first retainer 412 for supporting a torsion spring 413, a second retainer 414 for supporting a rolling contact member 416.

The first retainer 412 is substantially U-shaped. The first retainer includes two integrally formed spaced L-shaped side arms 418 joined by a centrally disposed cross bar 420. Each side arm 418 includes two inwardly extending pins 422 at the free ends. The first retainer 412 further includes a cylindrical rod 424 extending longitudinally therethrough.

The second retainer 414 is substantially T-shaped. The second retainer 414 is formed by a first member 428 and a second member 430 attached to and extending perpendicularly from the first member 328. The first member 428 is adapted to support two transversely extending pins 432. The second member 430 includes two slots 334 and 336. The first slot 334 receives the side arms 418. The second slot 336 receives the cylindrical rod 424.

Assembly and operation of the carriage 400 is similar to that discussed above in connection with FIGS. 1 and 6. However the connection between the first and second retainer allows one degree of freedom of movement between these parts.

The housing and its components and carriage may be injection molded from commercially available plastic. The torsion spring is commercially available and the contact pressure desired is achieved by varying the diameter of the spring material. The compression spring may be formed from beryllium copper.

The principal advantage of the contact mechanism is that the contact pressure can be maximized using the torsion spring, while wear is minimized due to using rolling friction. In addition the "wiping" action is performed by the sliding of the spring coils in the transverse direction.

An additional advantage is that contact pressure is stable because the torsion spring provides constant contact pressure over the life of the part. Due to the mechanical wear being minimized less expensive plating materials can be used and multiple layers of coatings to prevent wear are not necessary. In addition the single plating that is necessary need not be a noble metal but nickel or a nickel alloy will suffice.

Yet another advantage is that the system is more reliable due to the compression contact spring providing redundant multiple contact surfaces. An additional advantage is that the compression spring is self-lubricating and wears oxidation film due to the wiping action of the spring. During use any lubricant that is moved transversely during movement of the contact spring is returned when the contact spring compresses then recoils. Furthermore, these systems do not require tools for assembly of the contact mechanism, and if any of the elements of the contact mechanism needs to be replaced they are replaceable. In addition, the contact spring allows a substantially round configuration to be used. This provides a smaller contact area than previous designs, thus increasing the contact pressure at that point for better oxide film penetration. This round configuration also provides easy alignment and predictable contact pressure and wipe compared with stamped round configuration in the conventional spring leaf design.

While a particular invention has been described with reference to illustrated embodiments, various modifications of the illustrative embodiments, as well as additional embodiments of the invention, will be apparent to persons skilled in the art upon reference to this description without departing from the spirit and scope of the invention, as recited in the claims appended hereto. These modifications include, but are not limited to, modifying the carriage to include cylindrical rods instead of pins, however pins provide for easier assembly of the springs to the carrier. The torsion spring may be replaced with a flat spring mounted to the housing or a flexible plastic finger. In other embodiments, the number of torsion springs can be increased. The housing design can be varied. It is therefore contemplated that the appended claims will cover any such modification or embodiments that fall within the true scope of the invention.

I claim:

1. A contact mechanism for use with an incomplete circuit terminating in at least two spaced stationary contacts, said contact mechanism comprising:

a housing;

a rolling contact member which is a compression contract spring being supported in rolling engagement by said housing; and a biasing member engaging said housing, said biasing member for forcing said rolling contact member to exert contact pressure against the stationary contacts; said rolling contact member having a circuit open position where said rolling contact member does not electrically connect the stationary contacts; and a circuit closed position where said rolling contact member electrically joins the stationary contacts.

2. The contact mechanism of claim 1, wherein said biasing member is a torsion spring.

3. The contact mechanism of claim 1, wherein said contact mechanism further includes a carriage including a first retainer for supporting said torsion spring; and a second retainer for supporting said compression contact spring, said first retainer being movably connected to said second retainer.

4. The contact mechanism of claim 1, wherein said contact mechanism further includes a carriage including a first retainer for supporting said torsion spring; and a second retainer for supporting said compression contact spring, said first retainer and said second retainer being attached by a ball-and-socket-joint.

5. A contact mechanism for use with an incomplete circuit terminating in at least two spaced stationary contacts, said contact mechanism comprising:

a housing;

a torsion spring;

a carriage including a compression contact spring;

a first retainer for supporting said torsion spring, said first retainer being movably engaged with said housing; and a second retainer for supporting said compression contact spring in rolling engagement therewith; said first retainer being movably attached to said second retainer; and said torsion spring engaging said housing, said torsion spring for forcing said compression contact spring to exert contact pressure against the stationary contacts; said compression contact spring having a circuit closed position where said compression contact spring does not electrically join the stationary contacts; and a circuit open position where said compression contact spring electrically joins the stationary contacts.

6. The contact mechanism of claim 5, wherein said first retainer and said second retainer are attached by a ball-and-socket-joint.

7. An electric switch comprising:

a contact housing having at least two spaced stationary electrical contacts;

a moving contact mechanism including a housing, a carriage supported on said housing, a first spring for biasing said carriage to a first position; and a rolling contact member supported on said carriage, said carriage being movable relative to said housing in a first direction to move said rolling contact member into contact with said at least two stationary contacts, said rolling contact member being rotatable about an axis, said first direction of movement of said carriage being non-parallel to said axis, and said rolling contact member having contact portions which are movable axially along said axis, a second spring bias biasing said moving contact elements along said axis.

8. The switch as recited in claim 7, wherein said rolling contact element is a spring member providing said second spring bias.

9. A switch as recited in claim 8, wherein said carriage supports said second spring member at two spaced ends.

10. A switch as recited in claim 7, wherein said first spring biases said rolling contact member against said stationary contacts when said carriage is in said contact position.

* * * * *